US008033199B1

(12) United States Patent
Noble

(10) Patent No.: US 8,033,199 B1
(45) Date of Patent: Oct. 11, 2011

(54) NAIL SET HAMMER

(76) Inventor: Martin G. Noble, Fairview, NC (US)

( * ) Notice: Subject to any disclaimer, the term of this patent is extended or adjusted under 35 U.S.C. 154(b) by 0 days.

(21) Appl. No.: 12/802,489

(22) Filed: Jun. 9, 2010

(51) Int. Cl.
*B25D 1/00* (2006.01)
*B25G 1/08* (2006.01)

(52) U.S. Cl. ..... 81/23; 81/490

(58) Field of Classification Search ..... 81/20, 23, 81/24, 490, 177; 7/143, 145
See application file for complete search history.

(56) References Cited

U.S. PATENT DOCUMENTS

| | | | | | |
|---|---|---|---|---|---|
| 722,899 | A * | 3/1903 | Reeder | 81/20 |
| 1,028,008 | A * | 5/1912 | Eslick, Jr. | 7/168 |
| 1,109,507 | A * | 9/1914 | Bostock | 81/23 |
| 1,712,343 | A * | 5/1929 | Gerhardt | 81/20 |
| 2,721,340 | A * | 10/1955 | Shultz | 7/145 |
| 4,268,927 | A * | 5/1981 | Bridwell | 81/20 |
| 2010/0154598 | A1 * | 6/2010 | Sergyeyenko et al. | 81/23 |

* cited by examiner

*Primary Examiner* — Hadi Shakeri

(57) ABSTRACT

Nail set hammer with a hand held hammer, a nail set tool, a cover panel, a compression spring and a magnet. The hammer handle has a recessed portion capable of storing the nail set tool. The recess portion is enclosed by the cover panel which is flush with the outside surface of the hammer handle. The cover panel includes a downwardly disposed magnet that holds the nail set tool in place within the recess. The cover is attached to the handle by a hinge pin so that when a person presses on the end of the cover panel, the nail set tool is lifted from within the recess so that it can be removed by the user. The nail set tool can be easily removed and replaced from the recess by the user without undue interruption of the nailing or nail setting operations being performed by the user.

2 Claims, 6 Drawing Sheets

NAIL SET HAMMER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable carpentry tools and more specifically to a hammer containing a nail set tool within it.

Many times, during the course of a standard home or office construction job it is necessary to recess the head of a finishing nail by using a standard nail set tool and a hammer. The tip of the nail set tool is placed on the center of the head of the nail and the user pounds on the top of the nail set tool with a standard hammer thereby driving the head of the nail just below the surface of the material being nailed. A wood filler putty is then placed over the recessed nail head. The putty hardens and then is sanded so that all visible traces of the nail head are gone.

This process requires the user to find the nail set tool each time, then use the tool, and then return the tool to a location where it can be easily retrieved the next time it is required. To this end, some inventors have patented a means to hold or contain the nail set tool within the handle portion of a hammer. These include G. W. Gerhardt's U.S. Pat. No. 1,712,343 and P P Bridwell's U.S. Pat. No. 4,268,927, both of which provide a hollow space within a hammer capable of storing a tool such as a nail set.

However, there is a deficiency in the prior technology in that it still requires time and effort to remove an end cap located at the end of the hammer handle and remove the tool.

BRIEF SUMMARY OF THE INVENTION

The primary object of the invention is to provide a hammer whose handle includes a recess for storing a nail set tool.

Another object of the invention is to provide a hammer and nail set tool whose recess includes a pivoting cover that, in its closed position, is flush with the outer surface of the hammer handle.

Another object of the invention is to provide a hammer and nail set tool whose cover includes a magnet that holds one surface to the nail set tool so that when the user presses on the cover, it swings up and takes the nail set tool along with it for easy removal.

A further object of the invention is to provide a hammer nail and nail set tool that allows a person to hold the hammer handle with one hand and easily and quickly remove or replace the nail set tool with the other hand.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a nail set hammer comprising: a hand held hammer, a nail set tool, a cover panel, a compression spring and a magnet, said hammer comprised of a handle member and a head member, said hammer handle having a recessed portion capable of storing said nail set tool, said recessed portion enclosed by said cover panel, said cover panel being flush with the outside surface of said hammer handle, said cover panel including a downwardly disposed magnet, said nail set tool held in place within said recess by contact with said magnet, said cover attached to said handle by a hinge pin, said hinge pin located at approximately three quarters of the length of said cover panel, said compression spring located within said recess and directly under the distal end of said cover panel, so that when a person presses on the distal end of said cover panel said nail set tool is lifted from within said recess to be removed by said person.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
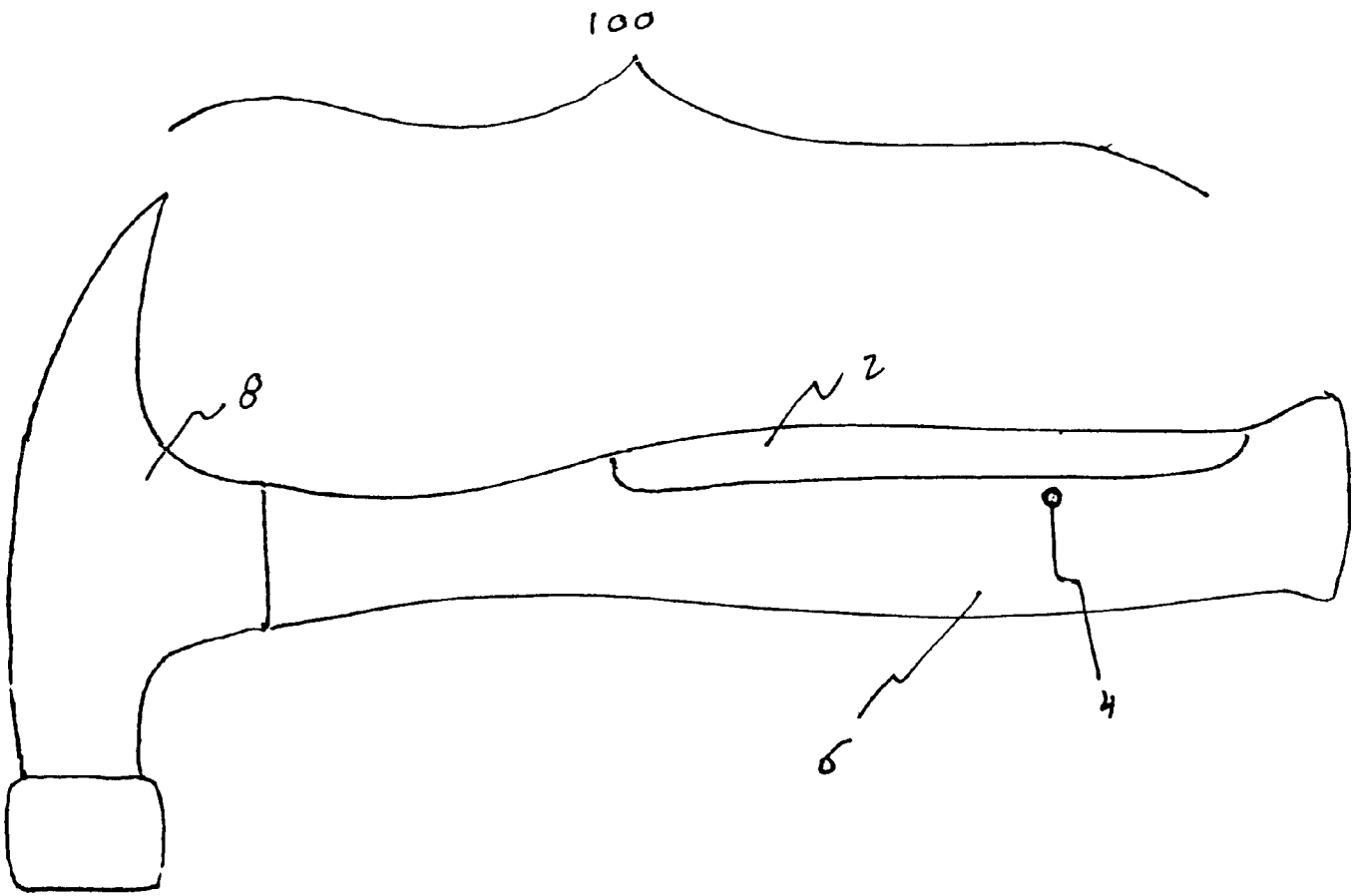
FIG. 1 is aside view of the invention.

Referring now to FIG. 1 we see a side view of the present invention 100. The invention 100 looks like a standard hand held hammer comprised of a head portion 8 and a handle portion 6, however upon closer inspection one can see the outline of a cover plate 2 that is set into the handle 6 so that it is flush with the outside contours of the handle 6. The cover plate 2 is pinned to the handle by pivot pin 4 which also terminates in a way that its ends are flush with the outside surface of handle 6.

Figure 2:
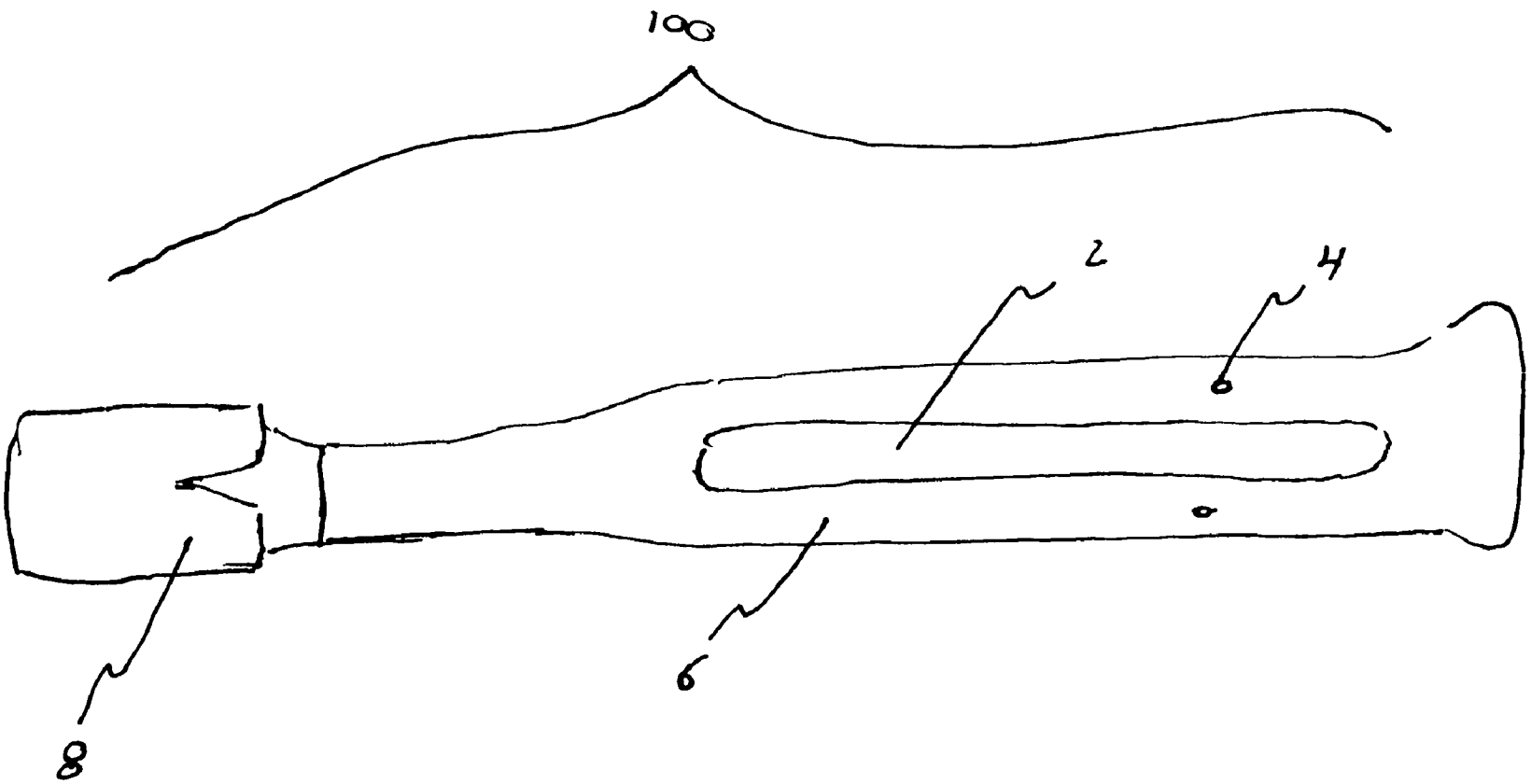
FIG. 2 is a top view of the invention.

FIG. 2 shows a top view of the invention 100 where the full contour of cover plate 2 can be seen.

Figure 3:
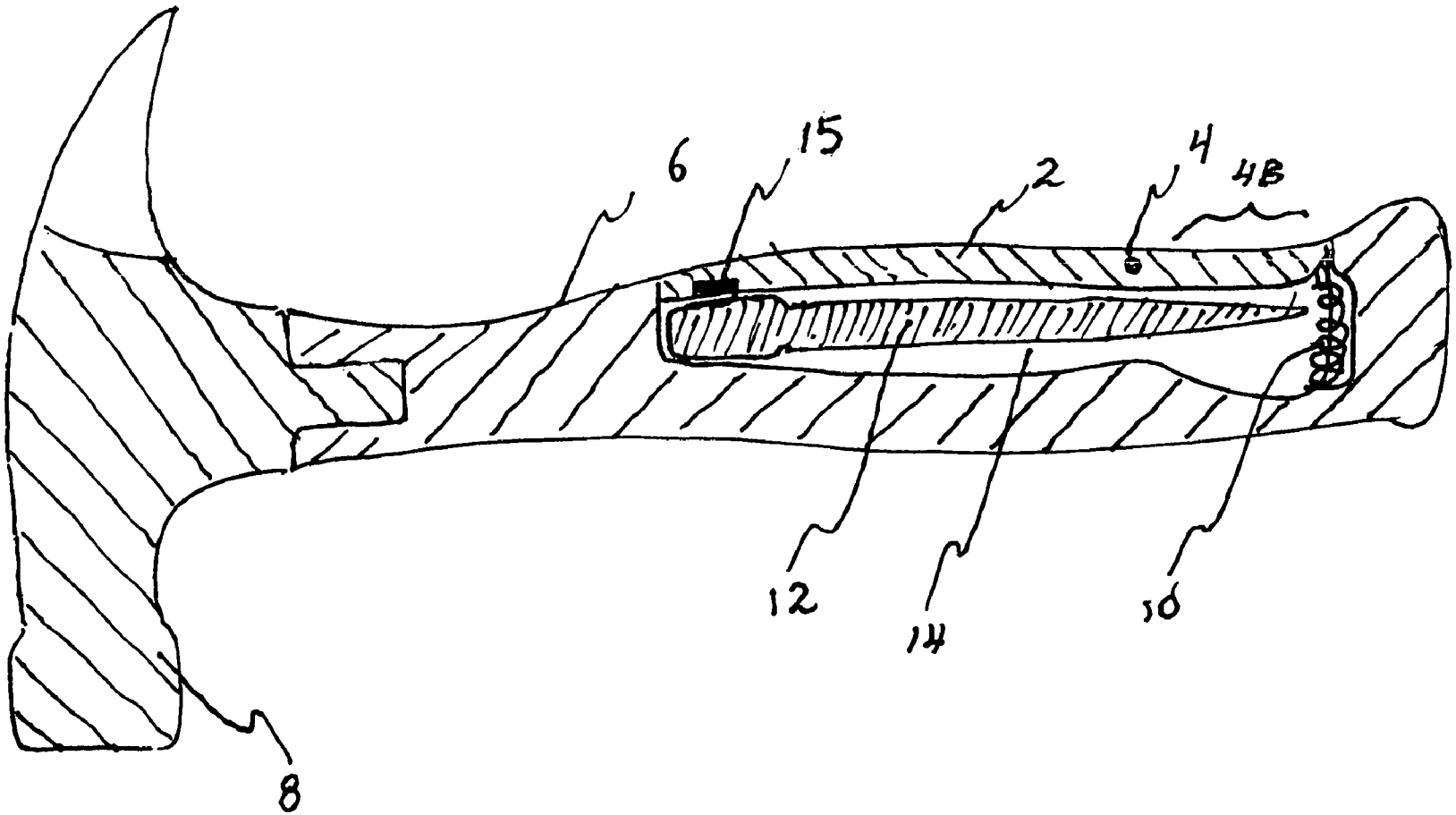
FIG. 3 is a side section view of the invention in the closed position.

FIG. 3 shows a side section view of the invention that bisects the hammer longitudinally. The handle portion 6 can be seen to have a recess 14 that is large enough to retain a standard nail set tool 12. The cover plate 2 can be seen attached to the hammer handle 2 by pivot pin 4. An internal compression spring 10 is located just under the distal end of cover plate 2. Cover plate 2 also has a downwardly disposed magnet 15 that is attracted to the nail set tool 12.

Figure 4:
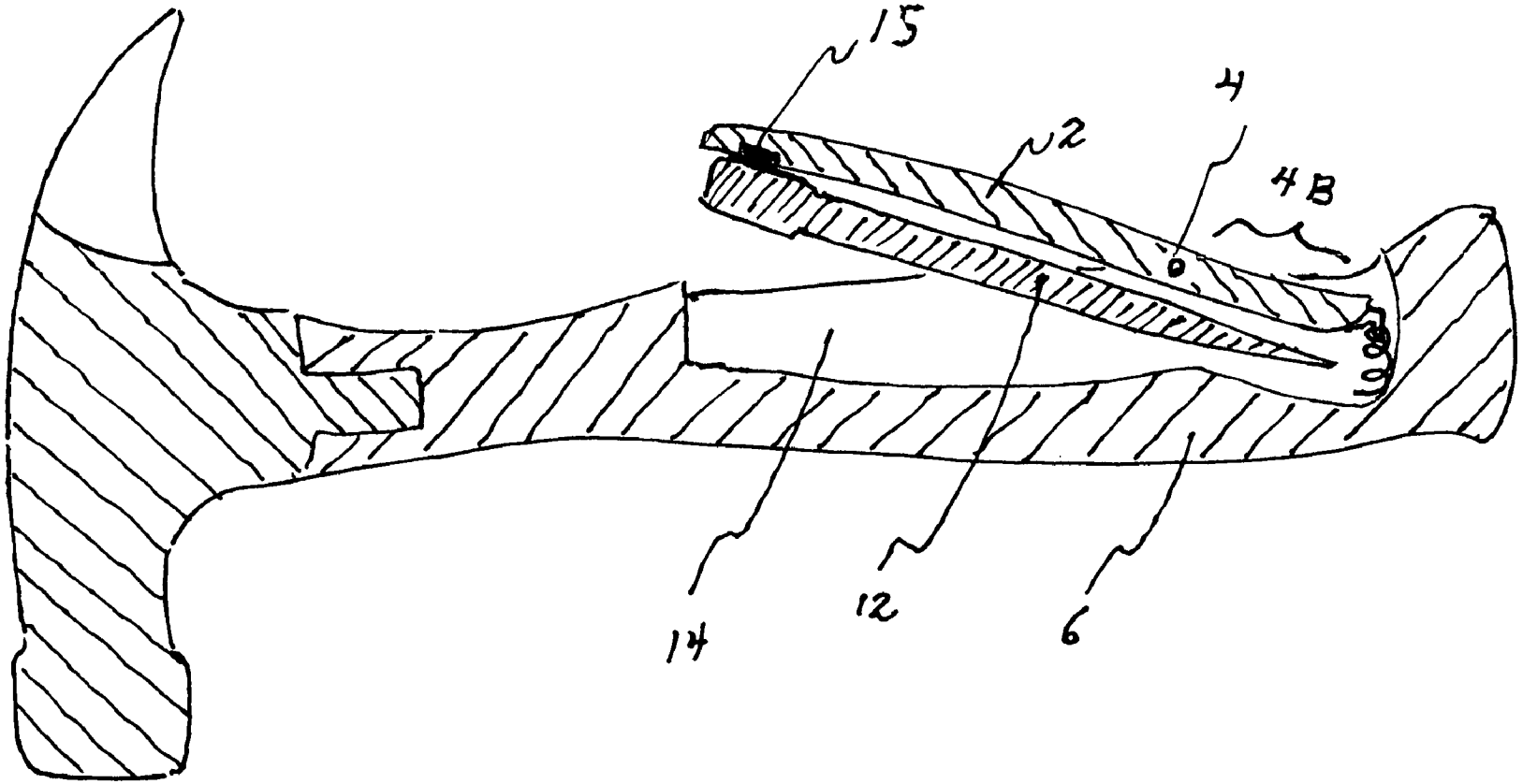
FIG. 4 is a side section view of the invention in the open position.

FIG. 4 shows the same side section view as FIG. 3 except that the cover plate 2 has been lifted by a downward pressure on the distal end 4B of the cover plate 2. The pivot pin 4 is located approximately three quarters of the way down the cover plate 2 so that when end 4B is pressed by the user, it causes the front end of cover plate 2 to rise and to take the nail set tool 12 with it thereby making is quick and easy for the user to have access to the nail set tool 12 when needed and just as easy to replace the tool 12 when needed. the use of the magnet 15 also means that there is no noticeable movement or sound that comes from the inside of the hammer handle 2 when a person is using the hammer 100 while banging in nails. Because the cover plate 2 is completely flush with the outside surface of the handle 6, the user's hand is not impeded in any abnormal way while using the hammer 100 for its intended purposes.

Figure 5:
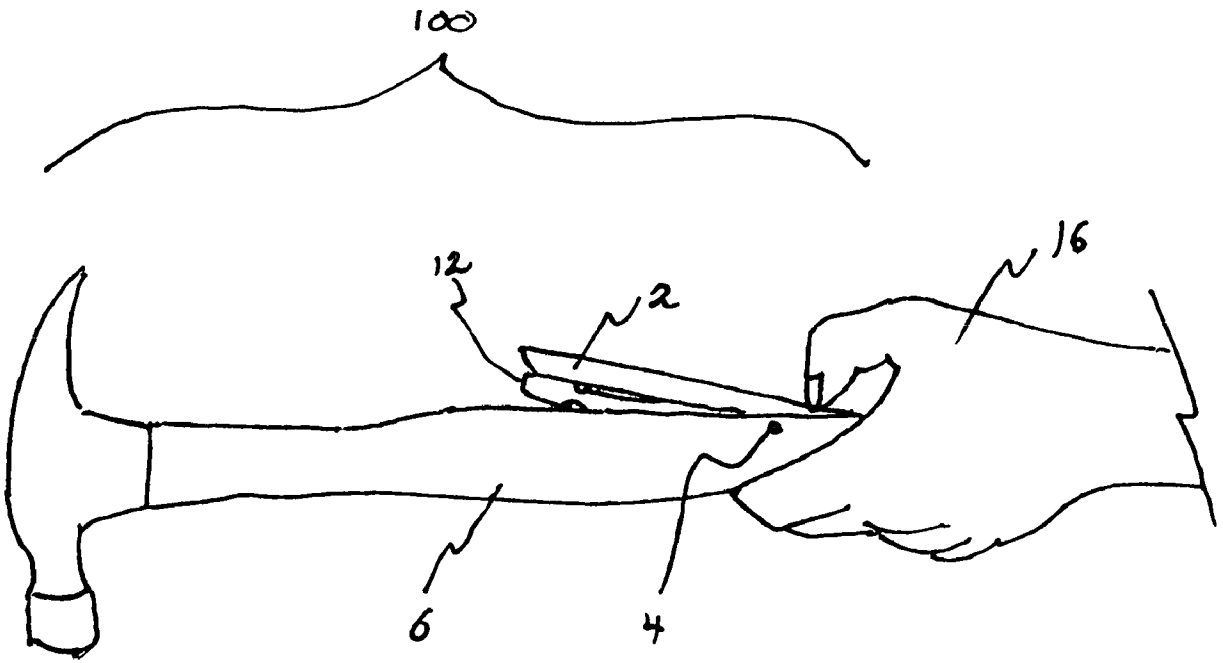
FIG. 5 is a perspective view of a person opening the cover of the handle portion of the hammer.
Figure 6:
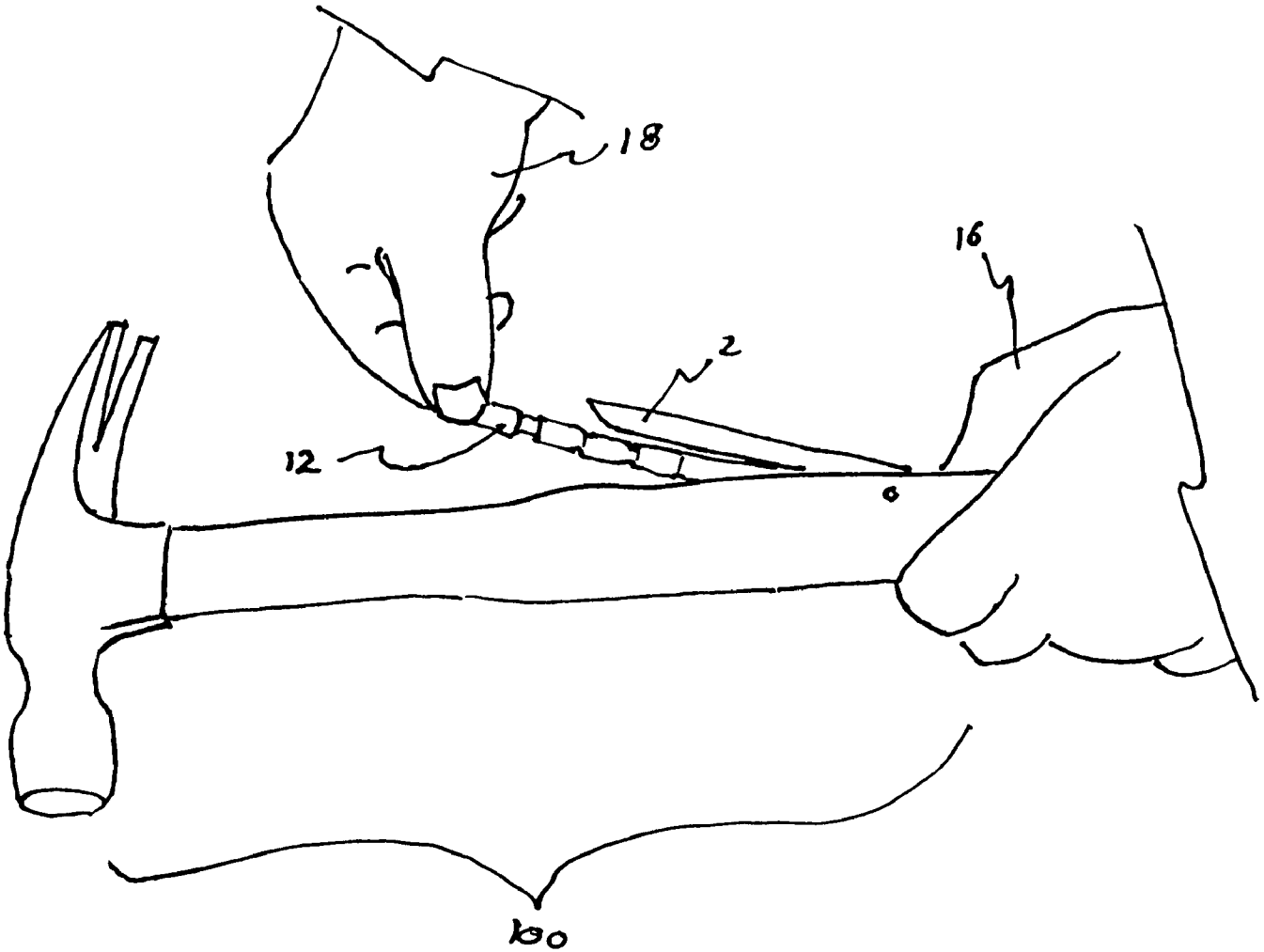
FIG. 6 is a perspective view of a person pulling the nail set tool out of its enclosure.

FIG. 5 shows a person holding the hammer 100 and pressing, with one finger 16, on the cover plate 2 to gain access to the nail set tool 12. The pressing action is quick and easy and allows direct access to the nail set tool 12. FIG. 6 shows a perspective view of the user 18 pulling out, or inserting the nail set tool 12. The operation is simple and quick so that the repeated use of the nail set tool can be accomplished without even visually looking at the removing and inserting operation.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A nail set hammer comprising:

a hand held hammer;

a nail set tool;

a cover panel;

a biasing member; and a magnet, wherein said hammer comprised of a handle member and a head member; said handle member having a recessed portion capable of storing said nail set tool;

said recessed portion enclosed by said cover panel;

said cover panel being flush with the outside surface of said hammer handle;

said magnet being downwardly disposed at a proximal end of said cover panel;

said nail set tool held in place within said recessed portion by contact with said magnet;

said cover attached to said handle by a hinge pin;

said hinge pin located at approximately three quarters of the length of said cover panel;

said biasing member located within said recessed portion and directly under a distal end of said cover panel;

so that when a person presses on the distal end of said cover panel said nail set tool is lifted from within said recessed portion to be removed by said person.

2. The nail set hammer as claimed in claim 1 wherein said biasing member is a compression spring and wherein said nail set tool can be easily removed and replaced from said recessed portion by the user without undue interruption of the nailing or nail setting operations being performed by the user.

* * * * *